US007484986B1

(12) United States Patent
Wu

(10) Patent No.: US 7,484,986 B1
(45) Date of Patent: Feb. 3, 2009

(54) SOCKET CONNECTOR WITH LOOSENING-PROOF STRUCTURE

(75) Inventor: Jui-Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 4 days.

(21) Appl. No.: 11/775,116

(22) Filed: Jul. 9, 2007

(51) Int. Cl.
*H01R 13/625* (2006.01)

(52) U.S. Cl. ..... 439/346

(58) Field of Classification Search ..... 439/346, 439/263, 370, 353, 358
See application file for complete search history.

(56) References Cited

U.S. PATENT DOCUMENTS 4,627,681 A * 12/1986 Hong ..... 439/370
5,791,931 A * 8/1998 Burkhart, Sr. ..... 439/346
5,893,772 A * 4/1999 Carmo et al. ..... 439/346
6,193,539 B1 * 2/2001 Chang ..... 439/346
6,558,183 B1 5/2003 Ji et al.
6,644,995 B1 * 11/2003 Jones et al. ..... 439/260
7,347,708 B1 * 3/2008 Huang ..... 439/346
2003/0207606 A1 * 11/2003 Ho ..... 439/346

* cited by examiner

*Primary Examiner*—Alexander Gilman
(74) *Attorney, Agent, or Firm*—WPAT, P.C.; Anthony King

(57) ABSTRACT

A socket connector with loosening-proof structure includes an insulating housing which defines insert holes in a front surface thereof and at least a receiving hole at one side thereof. The insulating housing has an upper cover and a lower cover. Electric terminals are received in the insulating housing respectively. Every electric terminal has a fix arm, an elastic arm locating at one side of the fix arm and a connecting portion extending from the rears of the fix arm and the elastic arm for connecting with a cable member. The elastic arm defines a guide portion at the front. The inner side of the guide portion defines a hook which tilts rearward to form a bevel plane. A button is configured in the receiving hole of the insulating housing. The button protrudes inward to form a shaft which is against the elastic arm.

7 Claims, 6 Drawing Sheets

SOCKET CONNECTOR WITH LOOSENING-PROOF STRUCTURE

BACKGROUND OF THE INVENTION

1. Field of the Invention

The present invention relates to a socket connector, and more particularly to a socket connector with loosening-proof structure for electrically connecting with a mating connector steadily.

2. The Related Art

As rapid development of electrical technology, many electrical connectors are used in variety of electric devices for electrically connecting with electric devices. A conventional electrical connector includes a socket connector and a mating connector. In order to make a secure connection between the socket connector and the mating connector, a lock mechanism is defined in the art of the electrical connector.

Refer to U.S. Pat. No. 6,558,183, which discloses an electrical connector with a lock mechanism, including a casing, a pair of lock members and a pair of release buttons. The lock member has a lock arm and a pawl extending from the lock arm. The pawls project beyond a front surface of the casing and are located on opposite sides of a front portion of the casing. The release buttons are detachably supported by opposite inner sides of the casing. The electrical connector engages with a mating connector, and the pawl engages with a counterpart lock portion of the mating connector to secure the electrical connector to the mating connector. Depress the release buttons inwardly to disengage the electrical connector from the mating connector.

As mentioned above, the electrical connector adds two lock members to secure the electrical connector to the mating connector. The structure of the design is complicated and the manufacture cost is increased. Therefore, an improved loosening-proof electrical connector needs to be designed to overcome the shortcomings of the described electrical connector.

SUMMARY OF THE INVENTION

Accordingly, an object of the present invention is to provide a socket connector with loosening-proof structure for electrically connecting with a mating connector steadily. The socket connector includes an insulating housing which defines insert holes in a front surface thereof and at least a receiving hole at one side thereof. The insulating housing has an upper cover and a lower cover which couple with each other to form the insulating housing. Electric terminals are received in the insulating housing respectively. Every electric terminal includes a fix arm, an elastic arm locating at one side of the fix arm and a connecting portion extending from the rears of the fix arm and the elastic arm for connecting with a cable member. The elastic arm defines a guide portion at the front. The inner side of the guide portion further defines a hook which titles rearward to form a bevel plane. At least a button is configured in the receiving hole of the insulating housing. The button protrudes inward to form a shaft which is against the elastic arm of the electric terminal.

It is to be understood that the design of the socket connector with loosening-proof structure utilizes the hook of the electric terminal to engage with a counterpart of a mating terminal of the mating connector to secure the electrical connection between the socket connector and the mating connector. So the design of the loosening-proof structure is simplified and the manufacture cost of the socket connector is reduced.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
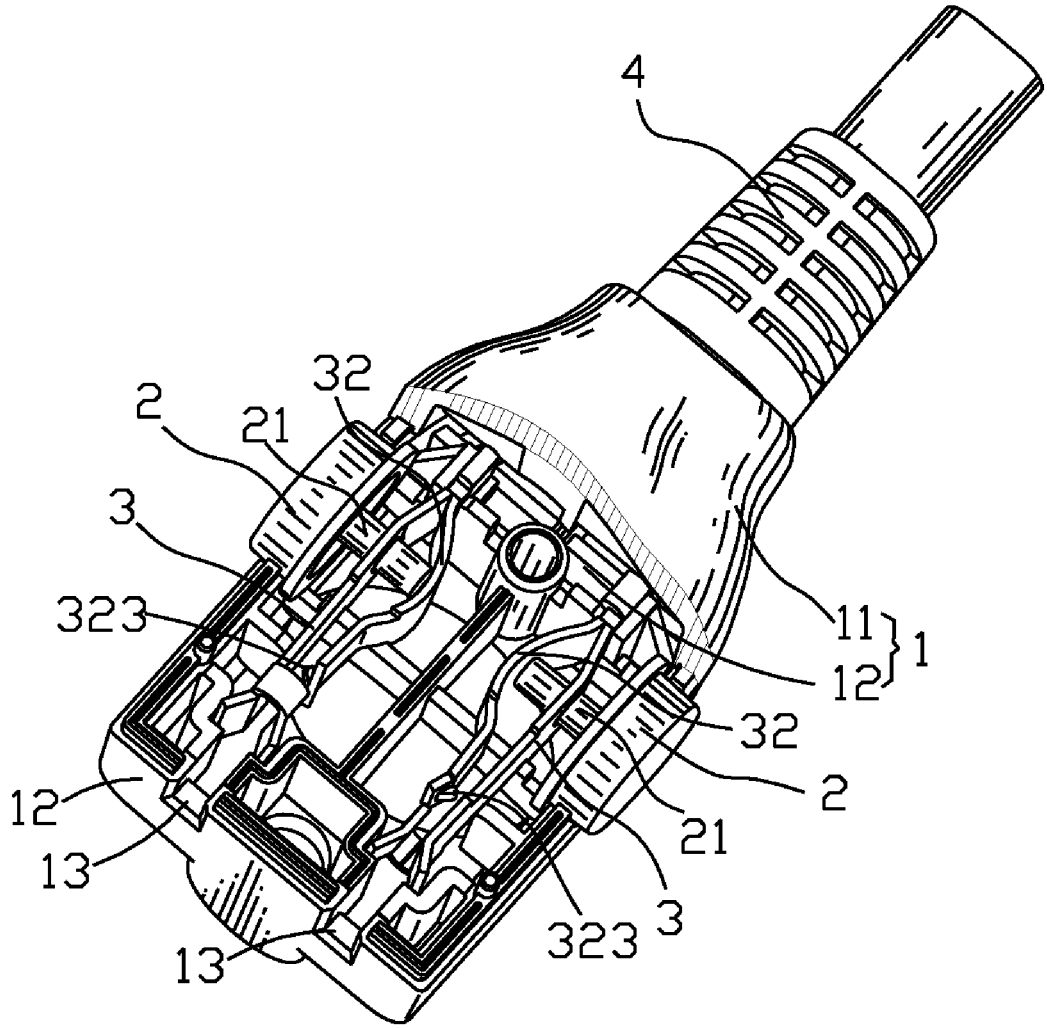
FIG. 1 is a perspective view of a socket connector according to a first embodiment of the present invention, which cuts an upper cover thereof partly.
Figure 6:
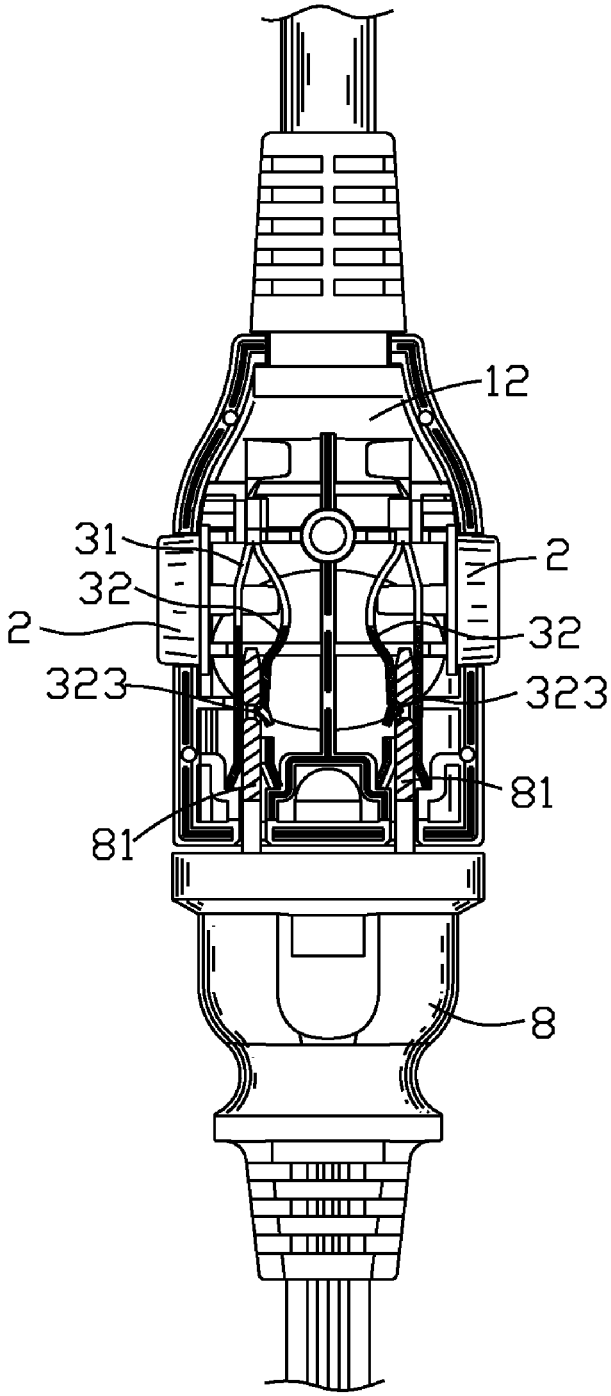
FIG. 6 is a vertical view illustrating the socket connector engaging with a mating connector without the upper cover.

Referring to FIG. 1, a socket connector with loosening-proof structure 100 according to a first preferred embodiment of the present invention includes an insulating housing 1. A cable member 4 is led through a back portion of the insulating housing 1. A pair of electric terminals 3 is accommodated in the insulating housing 1 and two buttons 2 are configured in the bilateral sides of the insulating housing 1. Two insert holes 13 are defined respectively in two sides of a front surface of the insulating housing 1 for engaging with a mating connector 8 (as shown in FIG. 6).

Figure 2:
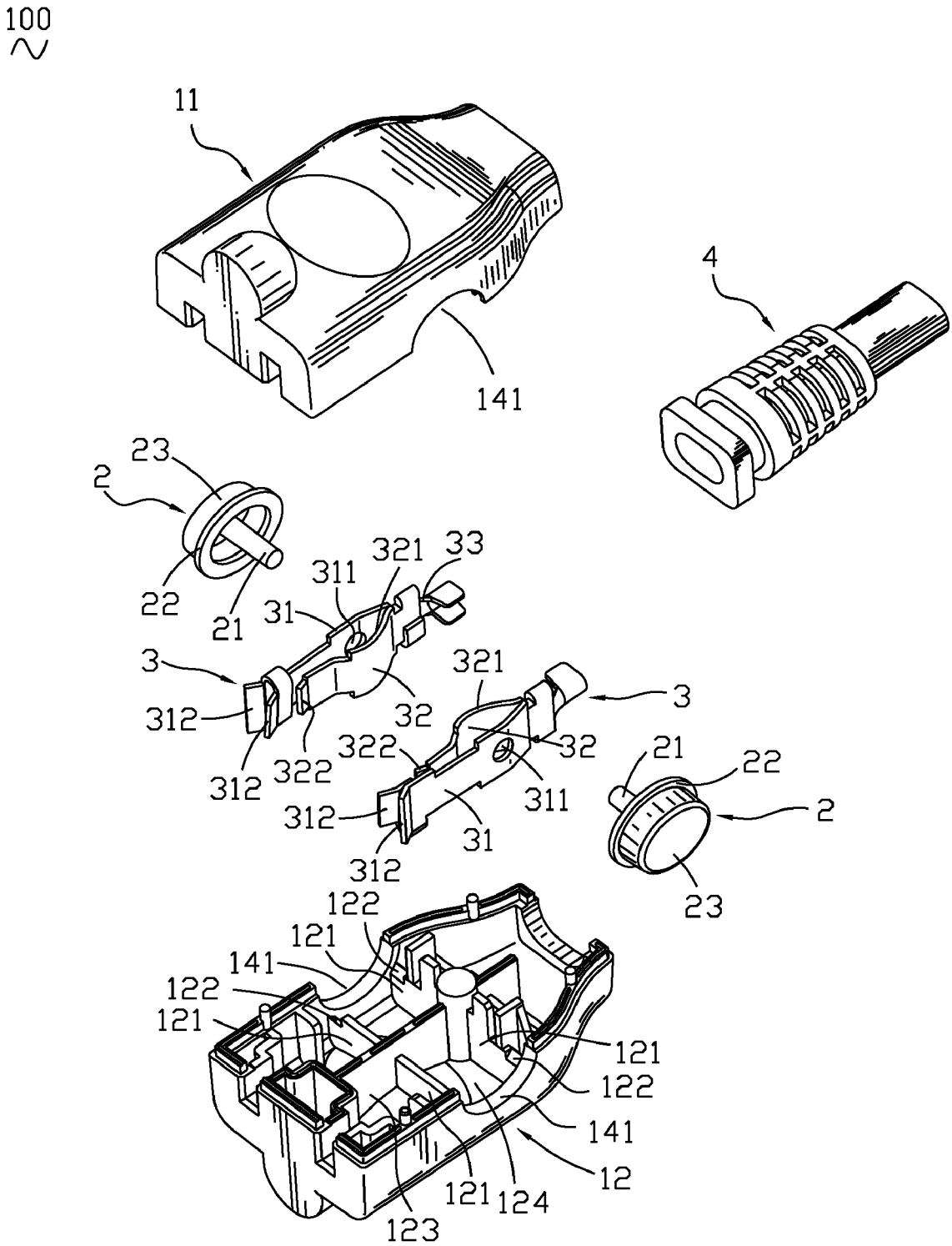
FIG. 2 is an exploded view of the socket connector.
Figure 4:
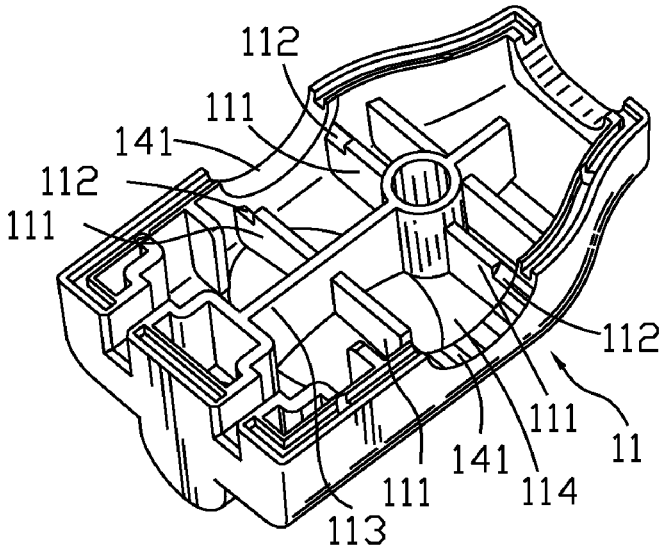
FIG. 4 is a perspective view of the upper cover of the socket connector.
Figure 5:
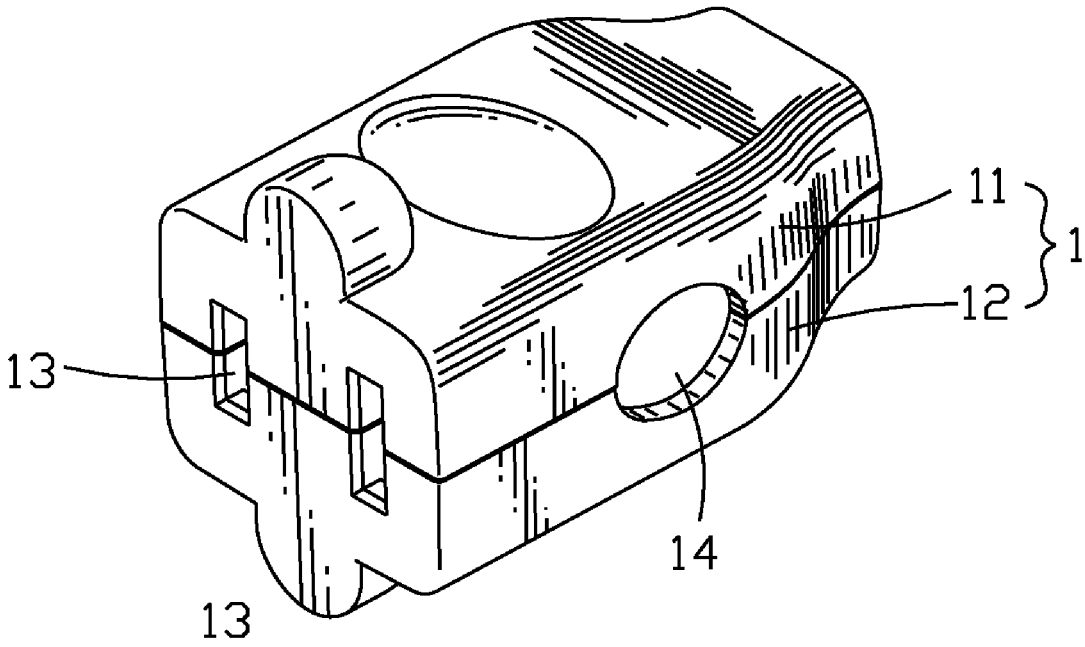
FIG. 5 is a perspective view showing the upper cover coupling with a lower cover of the socket connector.

Referring now to FIG. 2, FIG. 4 and FIG. 5, the insulating housing 1 includes an upper cover 11 and a lower cover 12. The bilateral sides of the insulating housing 1 define a receiving hole 14 respectively for accommodating the corresponding button 2. The upper cover 11 and the lower cover 12 define a pair of notches 141 that construct the receiving holes 14. The upper cover 11 protrudes downward to form a pair of first retaining walls 111 transversely from front and back, and both ends of the first retaining walls 111 connect with both sides of the upper cover 11 respectively. Each of the first retaining walls 111 are divided into two parts from the middle by a longitudinal first partition 113 to form a pair of first accommodating rooms 114 which face to the corresponding notches 141 respectively. A top portion of each first retaining wall 111 defines a first recess 112 connecting with the side of the upper cover 11. The lower cover 12 protrudes upward to form a pair of second retaining walls 121 transversely from front and back, and both ends of the second retaining walls 121 connect with both sides of the lower cover 12. The second retaining walls 121 are divided into two parts from the middle by a longitudinal second partition 123 to form a pair of second accommodating rooms 124 which face to the corresponding notches 141 respectively. A top portion of each second retaining wall 121 defines a second recess 122 connecting with the side of the lower cover 12. As the upper cover 11 is coupled with the lower cover 12 to form the insulating housing 1, the first retaining walls 111 and the second retaining walls 121 form a pair of retaining walls, and the first accommodating rooms 114 and the second accommodating rooms 124 construct two accommodating rooms respectively. The first recesses 112 and the second recesses 122 couple with each other to form two pairs of recesses.

Figure 3:
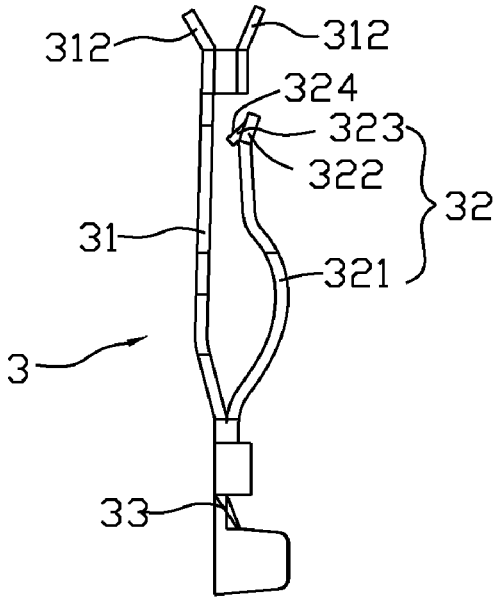
FIG. 3 is a perspective view of an electric terminal of the socket connector.

Please refer to FIG. 2 and FIG. 3. The electric terminal 3 arranged longitudinally in the insulating housing 1 includes a sheet fix arm 31, a sheet elastic arm 32 locating at one side of the fix arm 31, and a connecting portion 33 extending from the rears of the fix arm 31 and the elastic arm 32 and fixing the fix arm 31 and the elastic arm 32 together. The connecting portion 33 connects with the cable member 4 for electrical conduction. The fix arm 31 of the electric terminal 3 defines a shaft hole 311 therethrough. A pair of first guide portions 312 is defined at the front of the fix arm 31. The two first guide portions 312 define a receiving space therebetween for receiving a mating terminal 81 of the mating connector 8 (shown in FIG. 6). The elastic arm 32 of the electric terminal 3 defines an arc portion 321 that is opposite to the shaft hole 311. A second guide portion 322 is formed at the front end of the elastic arm 32. The second guide portion 322 is at the rear of the first guide portion 312. The inside of the second guide portion 322 defines a hook 323 which tilts rearward to form a bevel plane 324.

Referring to FIG. 2 again, the button 2 includes a cylinder-shaped pressing portion 23. The central of the inner side of the pressing portion 23 protrudes inward to form a shaft 21. A flange 22 is formed from the outside of the inner circle of the pressing portion 23.

As shown in FIG. 1, the electric terminals 3 are received in the insulating housing 1 longitudinally with the fix arms 31 facing to the receiving holes 14 respectively and the elastic arms 32 placing in the inner sides of the insulating housing 1. The shaft holes 311 and the arc portions 321 are arranged in the accommodating rooms. The buttons 2 are configured in the receiving holes 14 respectively. The pressing portions 23 are exposed outside the insulating housing 1 so as to facilitate users to operate. The flanges 22 of the buttons 2 are arranged in the recesses to limit the distance traveled by the buttons 2. So on one hand the flanges 22 prevent the buttons 2 from departing from the insulating housing 1, and on other hand the flanges 22 avoid the buttons 2 pressing the elastic arms 32 of the electric terminals 3 overly. The shaft 21 of the button 2 is inserted in the shaft hole 311 of the fix arm 31 and against the elastic arm 32. The two electric terminals 3 are separated by the partitions 113, 123.

Referring to FIG. 6, when the mating connector 8 is inserted in the socket connector 100, the mating terminals 81 of the mating connector 8 are inserted in the insert holes 13 of the insulating housing 1 and further inserted in the electric terminals 3 along the first guide portions 312 and the second guide portions 322. The hook 323 is inserted in a counterpart of the mating terminal 81 along the bevel plane 324. So the mating connector 8 is hard to depart from the socket connector 100 and ensures steady connection therebetween. When the mating connector 8 is pulled out of the socket connector 100, depress the pressing portions 23 of the buttons 2 inwardly and the shafts 21 push the arc portions 321 of the elastic arms 32 to make the intervals between the fix arms 31 and the elastic arms 32 become wider. Then the hooks 323 are removed from the counterpart of the mating terminals 81. Therefore, the mating connector 8 is easy to pull out of the socket connector 100.

As described above, the design of the socket connector with loosening-proof structure 100 utilizes the hook 323 of the electric terminal 3 to engage with the counterpart of the mating terminal 81 of the mating connector 8 to secure the electrical connection between the socket connector 100 and the mating connector 8. The electric terminal 3 has two functions that first the electric terminal 3 makes electrical connection with the mating connector 8, and second the electric terminal 3 provides loosening-proof structure to ensure the steady connection between the socket connector 100 and the mating connector 8. So the design of the socket connector with loosening-proof structure 100 is simplified and the manufacture cost of the socket connector 100 is reduced.

Figure 7:
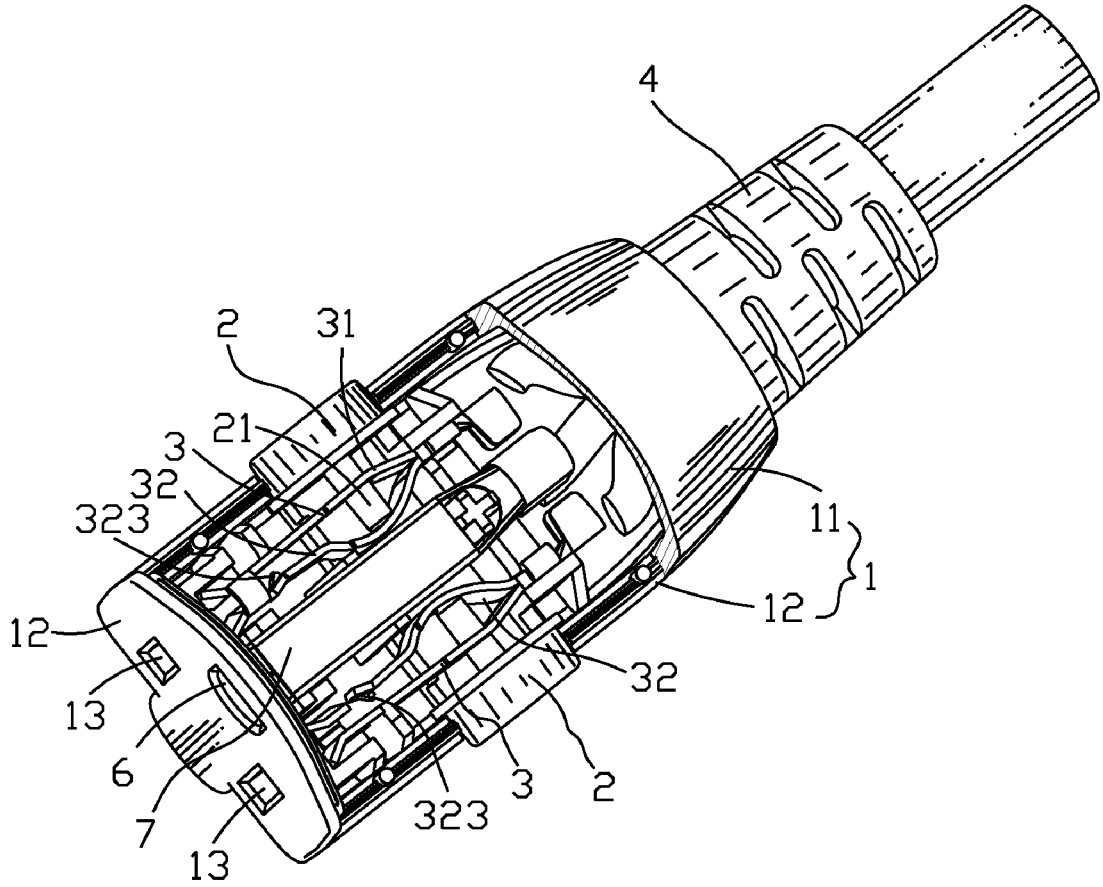
FIG. 7 is a perspective view of a socket connector according to a second embodiment of the present invention, which cuts an upper cover partly.

Please refer to FIG. 7 illustrating a second preferred embodiment of the present invention. Compared to the first preferred embodiment, a socket connector of the second preferred embodiment increases a third insert hole 6 connecting with a ground terminal 7 to engage with a mating connector 8 which has three mating terminals. Besides the additional insert hole 6 and the ground terminal 7, the other structure of the socket connector and the operating method are as same as the socket connector 100 disclosed in the first preferred embodiment, so it will not be described anymore.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A socket connector, comprising:

an insulating housing defining insert holes in a front surface thereof and at least a receiving hole at one side thereof, having an upper cover and a lower cover which couple with each other to form the insulating housing;

electric terminals received in the insulating housing respectively, every electric terminal having a fix arm, an elastic arm locating at one side of the fix arm and a connecting portion extending from the rears of the fix arm and the elastic arm for connecting with a cable member, the elastic arm defining a guide portion at the front, the inner side of the guide portion defining a hook which tilts rearward to form a bevel plane; and at least a button, configured in the receiving hole of the insulating housing, the button protruding inward to form a shaft which is against the elastic arm of the electric terminal, wherein the button has a pressing portion which is exposed outside the insulating housing, the central of the inner side of the pressing portion protrudes inward to form the shaft, wherein the fix arm of the electric terminal defines a shaft hole, the shaft of the button passes through the shaft hole and is against the elastic arm.

2. The socket connector as claimed in claim 1, wherein the front of the fix arm defines two first guide portions which define a receiving space therebetween, the guide portion of the elastic arm is at the rear of the first guide portions of the fix arm.

3. The socket connector as claimed in claim 1, wherein the elastic arm of the electric terminal defines an arc portion opposite to the shaft hole, the shaft of the button is against the elastic arm of the electric terminal.

4. The socket connector as claimed in claim 3, wherein the outside of the inner circle of the pressing portion defines a flange, wherein the upper cover and the lower cover protrude to form a pair of retaining walls transversely from front and back, the retaining walls are divided into two parts from the middle by a longitudinal partition to form a pair of accommodating rooms which face to the receiving holes respectively, a top portion of the retaining wall defines a recess, the flange is placed in the recess.

5. A socket connector, comprising:

an insulating housing defining insert holes in a front surface thereof and at least a receiving hole at one side thereof, having an upper cover and a lower cover which couple with each other to form the insulating housing;

electric terminals received in the insulating housing respectively, every electric terminal having a fix arm, an elastic arm locating at one side of the fix arm and a connecting portion extending from the rears of the fix arm and the elastic arm for connecting with a cable member, the elastic arm defining a guide portion at the front, the inner side of the guide portion defining a hook which tilts rearward to form a bevel plane; and at least a button, configured in the receiving hole of the insulating housing, the button protruding inward to form a shaft which is against the elastic arm of the electric terminal, wherein the front of the fix arm defines two first guide portions which define a receiving space therebetween, the guide portion of the elastic arm is at the rear of the first guide portions of the fix arm.

6. The socket connector as claimed in claim 5, wherein the button has a pressing portion which is exposed outside the insulating housing, the central of the inner side of the pressing portion protrudes inward to form the shaft, wherein the fix arm of the electric terminal defines a shaft hole, the shaft of the button passes through the shaft hole and is against the elastic arm, and wherein the elastic arm of the electric terminal defines an arc portion opposite to the shaft hole, the shaft of the button is against the elastic arm of the electric terminal.

7. The socket connector as claimed in claim 6, wherein the outside of the inner circle of the pressing portion defines a flange, wherein the upper cover and the lower cover protrude to form a pair of retaining walls transversely from front and back, the retaining walls are divided into two parts from the middle by a longitudinal partition to form a pair of accommodating rooms which face to the receiving holes respectively, a top portion of the retaining wall defines a recess, the flange is placed in the recess.

* * * * *